US005119910A

United States Patent [19]

Heggeland

[11] Patent Number: 5,119,910

[45] Date of Patent: Jun. 9, 1992

[54] QUICK CHANGE SHOULDER/HAND TOTE-STRAP

[75] Inventor: Bruce E. Heggeland, Barrington, Ill.

[73] Assignee: Bruce E. Heggeland, Inc., Barrington, Ill.

[21] Appl. No.: 666,355

[22] Filed: Mar. 8, 1991

[51] Int. Cl.[5] ..... A45C 13/22; A45C 13/26

[52] U.S. Cl. ..... 190/116; 150/108; 150/110; 224/257; 224/264

[58] Field of Search ..... 150/107, 108, 110; 190/115, 116; 224/205, 257, 264

[56] References Cited

U.S. PATENT DOCUMENTS

| | | | |
|---|---|---|---|
| 119,293 | 9/1871 | Alexandre | 190/115 |
| 126,432 | 5/1872 | Alexandre | 190/115 |
| 1,725,093 | 8/1929 | Maksik | 150/110 X |
| 2,394,782 | 2/1946 | Kalske | 150/108 X |
| 2,745,524 | 5/1956 | Plotkin | 190/115 |
| 2,960,137 | 11/1960 | Lipsitz | 150/108 X |
| 4,153,092 | 5/1979 | Haslam | 150/108 |
| 4,763,763 | 8/1988 | Sadow | 190/115 |
| 4,978,044 | 12/1990 | Silver | 150/108 X |

FOREIGN PATENT DOCUMENTS

| | | | |
|---|---|---|---|
| 133018 | 4/1933 | Austria | 150/108 |
| 878656 | 1/1943 | France | 150/107 |
| 2345101 | 2/1976 | France | 150/110 |
| 10318 | of 1906 | United Kingdom | 190/115 |
| 296657 | 9/1928 | United Kingdom | 150/110 |
| 785956 | 11/1957 | United Kingdom | 190/115 |

*Primary Examiner*—Sue A. Weaver
*Attorney, Agent, or Firm*—Lee, Mann, Smith, McWilliams & Sweeney

[57] ABSTRACT

A flexible tote-strap for luggage such as bags or cases for any portable articles embodies a unitary tripled up assembly of strapping held in short length for hand clutching by a quick release buckle with which the tote strap may very quickly be converted to a shoulder carrying tote-strap.

4 Claims, 2 Drawing Sheets

6
5
1
1
6
3
5
3
2
13
12
13a
16
14
15
11
13b
10
9
7
2
3
4
2

QUICK CHANGE SHOULDER/HAND TOTE-STRAP

BACKGROUND AND SUMMARY OF THE INVENTION

A wide variety of cases and bags are available for carrying from place to place all manner of articles such as instruments, portable electronic apparatus, tools, clothing, etc. Since the invention herein described is useful in association with almost any of this type of article, such cases and bags will be referred to herein for convenience by the generic term "luggage".

Since the function of the luggage is to manually carry portable articles, handles are almost invariably secured to the luggage for lifting and conveniently carrying them. One form of handle is a strap of flexible material preferably made from heavy fabric strapping. The ends of such handle straps may be either permanently or detachably fastened to the luggage. Such straps may be relatively short to be grasped and held by the hand of a person or may be of sufficient length to enable the luggage to be carried by the shoulder.

The invention herein described relates to luggage tote-straps which may be adjusted to the two different lengths so that the luggage may be carried either by the hand or by the shoulder. Such straps that are in common use comprise two segments of strapping, a short one which is secured at one end to the luggage and is provided with a simple slide buckle fastened to the other end and a long strap also secured to the luggage and trained through the buckle to secure against relative movement by friction of the two segments of strap together. When no tension is imposed upon the tote-strap, it may be adjusted to either hand or shoulder length by sliding the long segment through the slide buckle to lengthen or shorten the tote strap. Because the segments of the strap that engage each other and the buckle must be manipulated to disengage these parts sufficiently to eliminate friction when the long portion is pulled through the buckle to provide a tote-strap of hand or shoulder length, stress within the strap handle must be completely relieved in order to make this adjustment. This requires a substantial amount of time and effort and, when the tote-strap has been shortened to hand-carrying size, a long excess of the large segment is left dangling loose.

The object of the present invention is to provide a totestrap which can be almost instantaneously converted from the short hand grip length to shoulder length and vice versa. The entire strapping is contained within the tote-strap assembly with no loose end dangling. The three passes of strapping are within and a part of the tote-strap at both the hand and the shoulder settings. Pads may be provided for both the hand and shoulder at the respective settings.

BRIEF DESCRIPTIONS OF THE DRAWINGS

In the accompanying drawings.

DESCRIPTION OF MODE BEST EMBODYING THE INVENTION

Figure 1:
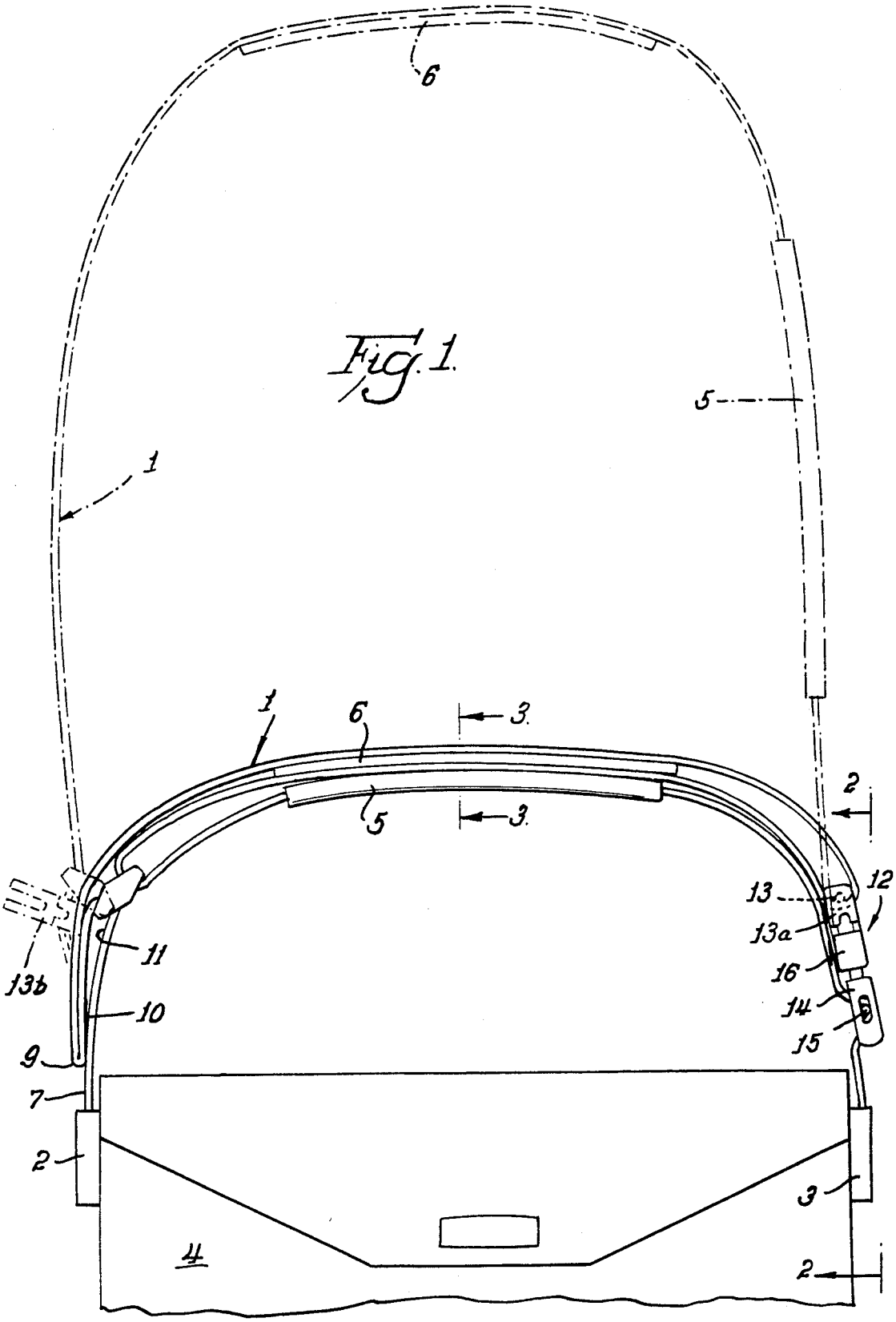
FIG. 1 is a side view of the shoulder/hand tote-strap of the invention shown secured to exemplary luggage, the hand strap setting being shown in solid lines and the shoulder strap setting being shown in dot-dash lines.
Figure 2:
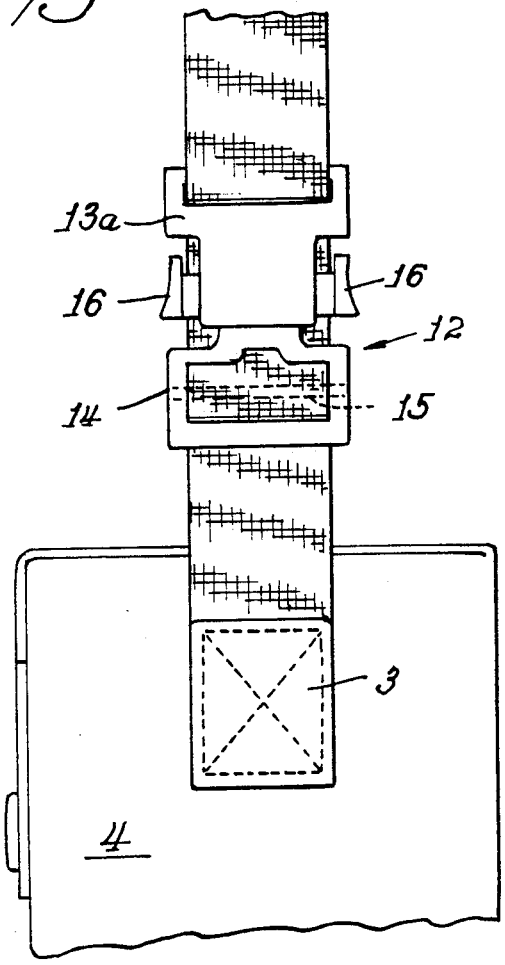
FIG. 2 is a detail view taken at the line 2—2 of FIG. 1.

The tote-strap 1 of the invention may advantageously be composed of strong webbing of suitable width to supply the necessary strength and also comfort to the hand or shoulder during use. It may, but need not necessarily, be a single continuous length of strapping. It is permanently anchored at its ends 2 and 3 to luggage 4 by any suitable means depending in part upon the nature of the material of which the luggage is made. As shown in FIGS. 1 and 2, the ends of the strap may be sewed to the top portion of the ends of the luggage. If desired, a hand clutch pad 5 of a suitable material such as leather or artificial leather may be secured as by sewing to the strap and a similar pad 6 may be provided for use in the shoulder setting of the tote-strap. The portion 7 of the strap adjacent end 2 is trained through a simple connector ring 8 and then back upon itself to a fold 9 and then carried back over the strapping to provide the triple thickness 10 at which location all three layers are sewed together forming loop 11. From the triple thickness joint 10 the strap extends over to a quick-release buckle 12 wherein it is trained over the fixed bar 13 Of the movable part 13*a* of quick-release buckle 12. The strap then extends back to connector ring 8 and then back once more to the quick-release buckle 12, all in zig-zag fashion thence, to the fixed part 14 thereof. After looping over friction bar 15, the strap continues down to its end 3.

In the posture of the tote-strap illustrated in solid lines in FIG. 1, the two parts of the quick-release buckle 12 are locked together so that the luggage may be lifted by grasping the tote-strap with the hand. The movable part 13*a* of the quickrelease buckle may be quickly released by the manual assertion of inward pressure at 16 and the similar area on the opposite side of the quick release buckle (see FIG. 2). When so released, the tote-strap may be unfolded from its zig-zag position to its full shoulder length by merely lifting the strap upwardly to the shoulder position shown in dot-dash lines in FIG. 1. In so doing, the movable part 13*a*of quick-release buckle 12 is free to travel to the location 13*b*at the triple thickness joint 10 where it has no function.

It will be noted that when tripled up to the arrangement shown in solid lines of FIG. 1, pad 5 is in position to protect the hand while when released and in the position shown in dot-dash lines, pad 6 is in position to protect the shoulder.

To convert from the shoulder-carrying position shown in dot-dash lines to the hand-carrying position, shown in solid lines, it is only necessary to grasp the movable part of the quick-release buckle and pull the strap back into the tripled up position and snap the movable part into the fixed part of the quick-change buckle to lock the strap in the hand-carrying position.

Figure 3:
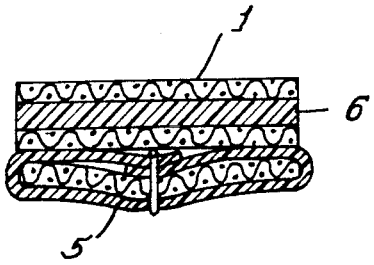
FIG. 3 is a cross-sectional view taken at the line 3—3 of FIG. 1.
Figure 4:
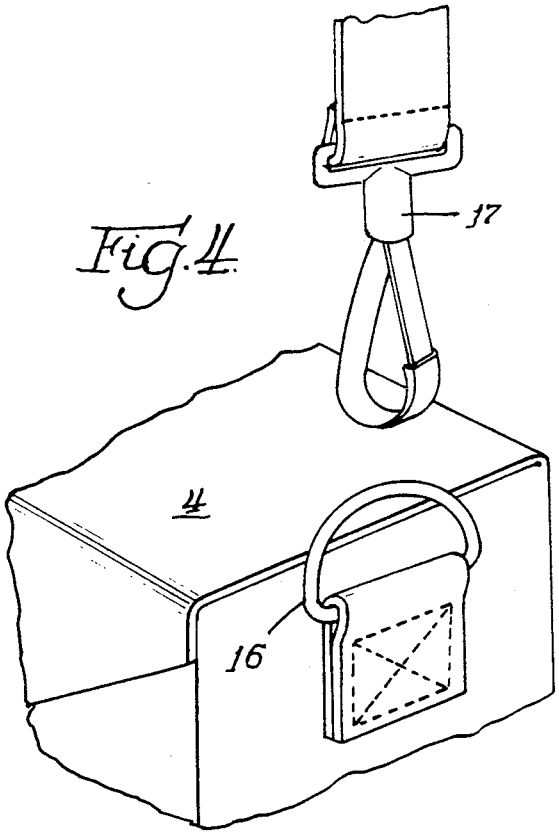
FIGS. 4 and 5 are detail perspective views showing examples of alternative means of attaching the tote-strap to the luggage.
Figure 5:
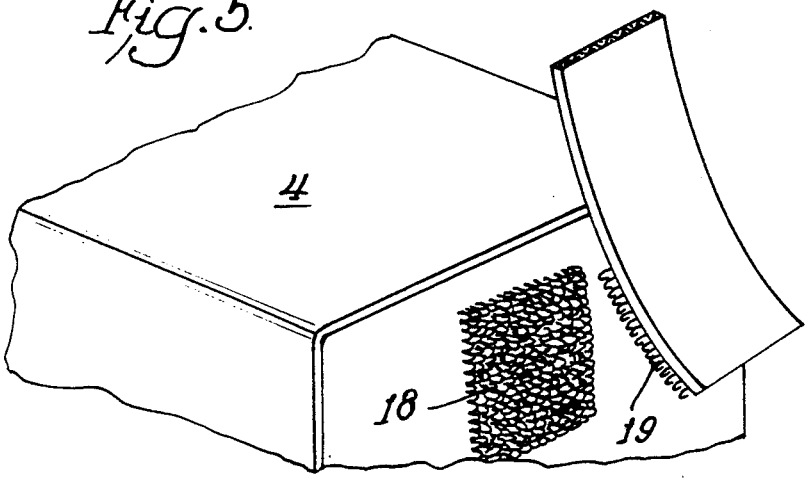

If desired, instead of sewing or otherwise fastening the ends of the tote-strap permanently to the luggage, it may be removably anchored to the luggage by any of several means, two of which are shown in FIGS. 3 and 4. In FIG. 3, D-ring 16 is fastened to the upper portion of the end of a luggage and a spring hook 17 is secured to the end of tote-strap. In FIG. 4, a hook and loop connector may be provided, one element 18 being permanently cemented to the luggage and the other element 19 being cemented or otherwise fastened to the end of the strap.

ACHIEVEMENT

The invention herein described provides a tote-strap for luggage, such as cases or bags, for any portable articles which enables a person to very quickly convert from a relatively short handle for hand-carrying to a relatively long strap for carrying the luggage from a shoulder and vice versa. The novel arrangement may be composed of a single length of strapping from end to end all of which is contained within the strap assembly in both hand- and shoulder-carrying assemblies.

I claim:

1. A tote-strap for luggage convertable for use either as a short hand-carrying tote-strap or a long shoulder-carrying tote-strap and comprising a strap of flexible material having a connection ring secured to said strap adjacent the first end thereof, and a quick-release buckle having a fixed part and a movable part, said fixed part of said quick-release buckle being affixed to said strap adjacent the second end thereof. said movable part of said quick-release buckle being strung onto said strap between said first end thereof and said connection ring in position to latch onto said fixed part this folding said strap in zig-zag fashion to effect said short hand-carrying mode, said strap extending form said first end through said movable part of said quick release buckle, then through said connection ring and then through said fixed part of said quick-release buckle and then to said second end of said strap.

2. A tote-strap in accordance with claim 1 wherein said tote-strap is constituted of a single length of strapping the portion of said strap extending from said second end to said first part of said quick-release buckle being free of any functional part affixed thereto.

3. A tote-strap in accordance with claim 1 and including a shoulder pad and a hand pad affixed to said strap.

4. A tote-strap in accordance with claim 1 having means at each end thereof for detachably connecting said strap to luggage.

* * * * *